United States Patent [19]

Okamoto et al.

[11] 4,103,054

[45] Jul. 25, 1978

[54] SUEDE-LIKE RAISED WOVEN FABRIC AND PROCESS FOR PREPARATION THEREOF

[75] Inventors: Miyoshi Okamoto, Takatsuki; Syusuke Yoshida, Otsu, both of Japan

[73] Assignee: Toray Industries, Inc., Tokyo, Japan

[21] Appl. No.: 805,873

[22] Filed: Jun. 13, 1977

[30] Foreign Application Priority Data

Jun. 17, 1976 [JP] Japan ..... 51-70379

[51] Int. Cl.[2] ..... B32B 33/00; D06C 11/00

[52] U.S. Cl. ..... 428/91; 26/29 R; 26/30; 26/31; 26/33; 28/159; 28/107

[58] Field of Search ..... 428/91; 26/29 R, 30, 26/31, 33; 28/72 P, 72 NW, 72 HR

[56] References Cited

U.S. PATENT DOCUMENTS 3,865,678 2/1975 Okamoto et al. ..... 428/91

*Primary Examiner*—Marion E. McCamish

*Attorney, Agent, or Firm*—Cushman, Darby & Cushman

[57] ABSTRACT

Disclosed is a suede-like raised woven fabric of a combination weave. A yarn having a thickness in a range between 30 and 300 denier, the thickness of most of individual filaments or fibers thereof being in a range between 1.0 and 8.0 denier, is utilized as the warp; while a spun yarn having a thickness represented by a total denier in a range between 50 and 1000 denier, the thickness of the most of individual component fibers thereof being in a range between 0.0001 and 0.4 denier, is utilized as a first weft, and a yarn having a fineness represented by a total denier in a range between 30 and 300 denier, the thickness of the most of individual filaments or fibers thereof being in a range between 1.0 and 8.0 denier, is utilized as a second weft. At least one of the warp and the second weft does not substantially involve crimped filaments or fibers. A combination woven fabric structure provided with a number of floating points of the first weft upon the warp in a range between three and seven is adopted. The fabric is subjected to the raising process so as to mainly raise the very fine individual fibers of the first weft.

30 Claims, 6 Drawing Figures

SUEDE-LIKE RAISED WOVEN FABRIC AND PROCESS FOR PREPARATION THEREOF

SUMMARY OF THE INVENTION

The present invention relates to a raised woven fabric of a combination weave, such as a weft backed weave, having a surface covered with raised extra fine fibers and having a suede-like touch, appearance and feel, and to a method for the manufacture thereof.

As raised woven fabrics having extra fine fibers therein and having a suede-like appearance and feel, there has heretofore been known, as is disclosed, for example, in the U.S. Pat. No. 3,865,678:

(a) raised woven fabrics utilizing spun yarn comprising a spun yarn consisting of plural staple fibers each being a bundle extra fine fibers used as the weft and a spun yarn consisting of fibers having a normal thickness used as the warp;

(b) raised woven fabrics having improved yarn slippage resistance between the warp and weft, excellent feeling to the touch and a high density of the raised fibers, which are produced by utilizing a weft which is a spun yarn consisting of plural bundles of extra fine fibers and a warp which is a high-bulky textured multifilament yarn of ordinary thickness, or a multifilament yarn with a potential crimp property, and are provided with a heat treatment after weaving, and;

(c) raised woven fabrics of the above-mentioned fabrics (b), having the weft back weave construction, and particularly, a false twisted multifilament yarn used for the warp and the second weft so as to cover the back surface of the fabrics mainly by the warp and the second weft.

These conventional raised woven fabrics, and particularly the latter two, have some excellent features as suede-like fabric. However, they have the following drawbacks as fabrics and in their manufacturing processes.

(1) In the case of the above-mentioned fabric (c), wherein a false-twisted multifilament yarn is used as the warp and a part of the weft, the product tends to become poor in thick and fleshy feel due to the high contraction in both the warp and weft directions, and in sewing quality and dimensional stability due to its high stretchability. Moreover, it is difficult to heat set the fabric under a constant tension in the warp direction because of its high stretchability in the warp direction and, thus, it is difficult to produce a product having a constant quality in the warp direction.

(2) In the case of the above-mentioned fabric (c), the cost of the fabric is rather expensive in comparison with fabrics utilizing non-textured yarn.

(3) Concerning the quality of the fabric, the above-mentioned fabric (c) has the drawback that the product tends to have a harsh backside surface, in other words, the product does not have a smooth and slippery feel which is normally required for a fabric material used for making wearing apparel. It must also be noted that the face surface of the fabric may also be inferior in smoothness.

(4) In the case of producing the above-mentioned fabric (b) and (c), the warping operation is difficult and streaking along the warp direction or unevenness of the warp and weft arrangement are possibly created in the fabric. Further, the uniformity of the picking of the weft utilizing the textured multifilament yarn is unstable.

The above-mentioned drawbacks related to the above-mentioned known fabrics have not been eliminated, despite many concerted efforts to do so.

The present invention is the result of thorough studies directed to clearing up the causes of the above-mentioned drawbacks and to developing a specific construction based on the results of the investigation of the causes. Accordingly, the objects of the invention are as follows.

(1) One object of the present invention is to eliminate the drawbacks of the known raised woven fabrics which are intended to be suede-like fabrics and the drawbacks in the manufacturing processes thereof.

(2) In the warping, weaving and the successive finishing processes, tension is mainly imparted to the warp and, therefore, in a case where a stretchable textured yarn is used as the warp, it is quite difficult to prevent the creation of uneven quality in a fabric due to the variation of warp tension. Consequently, it is another object of the present invention to solve this problem.

(3) A further object of the present invention is to provide a high quality suede-like fabric provided with excellent shrink-resistance, dimensional stability, good appearance and suede-like handling quality.

The above-mentioned objects of the invention can be attained by the following construction according to the invention, which provides a suede-like raised woven fabric of a combination weave having raised fibers covering the surface thereof. The fabric comprises:

a yarn of 30 to 300 denier, consisting mainly of fibers each having a thickness of 1.0 to 8.0 denier, used as warp;

a spun yarn of 50 to 1,000 denier consisting of plural staple fibers, each staple consisting of a bundle of extra fine component fibers of 0.0001 to 0.4 denier, used as a first weft, and;

a yarn of 30 to 300 denier consisting mainly of fibers, each having a thickness in a range between 1.0 and 8.0 denier, used as a second weft, at least one of said warp and said second weft being substantially free from crimps, each thread of said first weft floating over the adjoining 3 to 7 threads of said warp and said raised fibers consisting of said extra fine staple fibers which constitute said first weft of said fabric.

The invention also provides a process for the preparation of a suede-like raised woven fabric, which comprises the steps of:

(a) weaving a fabric of a combination weave, wherein at least one of the warp and a second weft is substantially free from crimps and each thread of a first weft floats over the adjoining three to seven threads of the warp, using as the warp a yarn of 30 to 300 denier consisting mainly of fibers each having a thickness of 1.0 to 8.0 denier, using as the first weft, a spun yarn of 50 to 1,000 denier of multi-core composite staple fibers, each staple fiber consisting of a bundle of extra fine fiber components each having a fineness of 0.0001 to 0.4 denier, and using as the second weft, a yarn of 30 to 300 denier consisting mainly of fibers each having a thickness of 1.0 to 8.0 denier;

(b) removing a component surrounding the cores of the multi-core composite fibers of the yarn constituting the first weft of the woven fabric;

(c) subjecting the woven fabric to heat treatment, and;

(d) subjecting the woven fabric to raising.

The invention further provides a process for the preparation of a suede-like raised woven fabric, which comprises the steps of:

(a) weaving a fabric of a combination weave, wherein at least one of the warp and a second weft is substantially free from crimps and each thread of a first weft floats over the adjoining three to seven threads of the warp, using as the warp a yarn of 30 to 300 denier, consisting mainly of fibers each having a thickness of 1.0 to 8.0 denier, using as the first weft, a spun yarn of 50 to 1,000 denier of a plurality of staple fibers, each staple fiber consisting of a bundle of extra fine fiber components each having a fineness of 0.0001 to 0.4 denier, and using as the second weft a yarn of 30 to 300 denier, consisting mainly of fibers each having a thickness of 1.0 to 8.0 denier;

(b) subjecting the woven fabric to heat treatment, and;

(c) subjecting the woven fabric to raising.

In the above description, the term "fiber" means "a continuous filament" or "a fiber having a certain length suitable fit for producing a spun yarn", while "staple fiber" means "a cut fiber made from a bundle of continuous filaments of a length suitable to produce a spun yarn", and "fiber component" means "a component of an island or core contained in a composite or conjugate filament".

The features and effects of the invention achieved by the above-mentioned structures and processes are as follows.

(1) The feel of the fabric is homogeneous in both the warp and weft directions because of balanced arrangements of warp yarns and weft yarns.

(2) The fabric has excellent dimensional stability and is easily sewn.

(3) The backside surface of the fabric is dry and smooth to the touch and, thus, no lining cloth is necessary when the fabric is used to make wearing apparel.

(4) The crease resistance is excellent.

(5) The fabric has excellent permanent pleating quality in the homogeneous condition in the warp and weft directions.

(6) The yarn slippage resistance is improved over that of conventional suede-like fabric by the combination weave of the fabric.

(7) The surface has smooth feel to the touch.

(8) The surface of the fabric has high quality suede-like appearance.

(9) The pilling resistance is excellent, even if a small amount of an anti-pilling agent has been used.

Because of the above features and effects, the raised woven fabric of the invention successfully overcomes drawbacks which have not heretofore been overcome, as shown in the comparative tables below.

Comparative Table 1

| Conventional raised or flocked fabric | Fabric of the present invention |
|---|---|
| Pilling resistance is poor. | Pilling resistance is excellent. |
| Strong possibility of fallen fibers. | Few fallen fibers. |
| Surface feel is rough. | Surface feel is smooth. |
| Raised fibers are coarse. | Raised fibers are quite dense. |
| Finger marks do not appear. | Genuine leather like finger marks easily appear. |
| Draping quality is poor. | Draping quality is excellent. |
| Raised fibes are not lustrous. | Raised fibers are lustrous. |
| Feel is hard and harsh. | Feel is soft. |
| Construction of textile weave is conspicuous. | Construction of textile weave is difficult to see. |

Comparative Table 1-continued

| Conventional raised or flocked fabric | Fabric of the present invention |
|---|---|
| Raised fibers are distributed uniformly with no variation. | Raised fibers are distributed in varied condition. |
| Raised fibers are not suede-like. | Raised fibers are suede-like. |

Comparative Table 2

| Known suede-like fabric (U.S.P. 3,865,678 etc.) | Fabric of the present invention |
|---|---|
| Pilling resistance must be improved by a large amount of an anti-pilling agent. | Pilling resistance is good where a small amount of an anti-pilling agent is used. |
| Permanent pleating quality is poor. | Permanent pleating quality is excellent. |
| Sheer fabric can not be obtained. | Sheer fabric can be obtained. |
| Feel is not homogeneous in the warp and weft directions. | Feel is homogeneous in both the and weft directions. |
| Crease resistance is poor. | Crease resistance is excellent. |
| Backside surface of the fabric is rough, and has fuzz. | Backside surface of the fabric is slippery, and has little fuzz. |
| Resiliency becomes poor through washing. | Feel and appearance are changed little through washing. |

DETAILED EXPLANATION OF THE INVENTION

Figure 1:
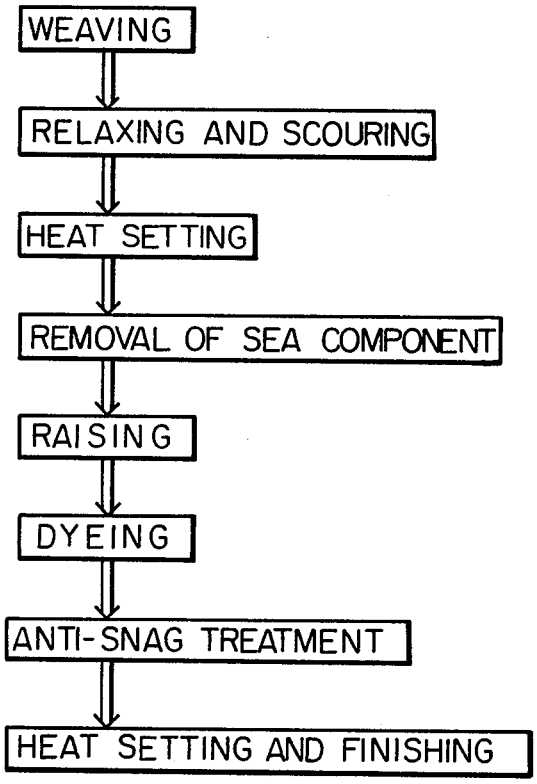
FIGS. 1, 2, 3, 4, 5 and 6 are flow charts of the method for manufacturing the suede-like fabric. The figures show various combinations of steps which can be used to preform the claimed method.

The invention is described hereinbelow in detail with reference to the preferred embodiments.

As the fiber-forming polymers constituting the yarn utilized for the fabric of the invention, various known fiber-forming polymers, such as polyethylene terephthalate and copolymers thereof, nylon 6, nylon 66 and nylons containing cyclohexane ring or benzene ring, can be employed alone or in combination. However, as the polymer for producing the extra fine fibers, polyesters capable of being dyed more deeply than the fibers of ordinary thickness such as those containing many amino groups (acid dyeable) or many sodium sulfonate groups (cationic dyeable), are preferably employed. This is because extra fine fibers having a dyeability similar to that of the fibers of ordinary thickness tend to appear, when dyed, lighter than the fibers of ordinary thickness. Thus, the colors of the extra fine fibers and of the fibers of ordinary thickness can be balanced. However, if desired, a combination of different polymers dyeable with different classes of dyes can be employed so as to obtain a multi-colored fabric or a fabric of different colored front and reverse side surfaces. Particularly, it is preferable to use such a warp that, when the fabric is woven, even though the warp consists of crimped filaments, such crimps are substantially eliminated in the weave construction. For example, such yarn as the so-called grey multifilament yarn recently produced, or the multifilament yarn which has been once subjected to texturing to impart crimps and thereafter the crimps have been substantially eliminated by a repeated stretching action during the weaving operation and by a subsequent heat setting operation of the fabric, correspond to the above-mentioned preferable warp yarn.

The individual filaments of the warp yarn (multiple filament yarn) must have a thickness in a range between 1.0 d and 8.0 d. When the thickness of the individual filament is less than 1.0 d, the resulting fabric becomes poor in crease resistance and in resiliency. Contrary to this, when the thickness of the individual filaments is larger than 8.0 d, the fabric becomes stiff and harsh, and moreover, the reverse side surface of the fabric has a hard and harsh feel to the touch. Thus, it is particularly preferable that the thickness of the individual filaments of the warp yarn be in a range between 1.2 d and 4.5 d.

The yarn utilized for the warp must have a total denier in a range between 30 d and 300 d. When the total denier is less than 30 d, processing, such as weaving, becomes difficult because of the frequent occurrence of yarn breakage, for example. When the total denier is more than 300 d, the resulting fabric becomes too thick and has an undesirable feel, and further, the texture becomes coarse. Particularly, where a high quality thin fabric is to be obtained, the total denier of the warp yarn is preferably in a range between 40 d and 100 d.

Even though textured yarns wherein the individual filaments are provided with crimps are preferably used as the warp yarn of a conventional material fabric for producing a fabric having a suede-like appearance, in the present invention a multifilament yarn, wherein the individual filaments does not substantially have crimps, is preferably utilized as the warp yarn. Therefore, when such a fabric is processed on a heat setter or dryer, it is not necessary to strictly control the tension or feed percentage during the processing and, thus, a fabric having excellent dimensional stability and uniform appearance and feel in the longitudinal direction can easily be created. Further, in the present invention, it is possible to employ a cheap non-textured yarn or grey yarn in the preparation of the fabric.

Next, the configuration and material of the first weft is explained in detail.

As already explained, a spun yarn composed of very fine staple fibers, the thickness of the yarn being in a range between 50 d and 1,000 d, which corresponds to a range in a cotton count system of $107^s$ and $5^s$, is preferably utilized as the first weft. It is preferable to use for this first weft a fine fiber having a fineness in a range between 0.0001 d and 0.4 d. The above-mentioned very fine fiber can be created by utilizing a particular staple fiber made from a tow of so-called composite filaments consisting of multiple components which involve components of very fine thickness. For example, when a composite fiber consisting of sea and island components which are combined in a condition of side by side disposition is utilized, the sea components are removed so that fine island components remain as very fine staple fiber components. Further, if a particular polymer-blend fiber provided with a non-dispersing component is utilized, such non-dispersing component is removed so as to create a very fine staple fiber component, after forming the material combined fabric. Instead of the above-mentioned method, a so-called super drawing method or method for splitting composite fibers may be applied to create the above-mentioned very fine staple fiber.

As already explained, the extra fine staple fibers constitute the first weft and the raised fibers in the fabric. Since the raised fibers are created from the extra fine fibers in the first weft, a suede-like desirable touch and appearance are created in the face surface of the fabric. Although the first weft may contain fibers of a fineness outside of the above-mentioned range, insofar as such suede-like quality of the fabric is not very adversely affected, it is preferable that the first weft contain as few such fibers as possible.

The raising of the extra fine fibers contained in the first weft may be carried out by means of a raising machine and the like. In the case of utilizing the above-mentioned composite fiber which contains very fine island components and sea components, the raising operation may be carried out on the material fabric at a suitable time before or after removing the sea components, by which a bundle of extra fine fiber components is created in each staple fiber of the first weft.

To create a compact weave and raised fibers on the resulting fabric, it is particularly desirable to use a first weft having a thickness in a range between 70 d and 450 d.

The configuration and material of the second weft is hereinafter explained in detail.

As the second weft, a yarn of a total denier in a range between 30 d and 300 d, consisting mainly of fibers of a thickness in a range between 1.0 d and 8.0 d, is employed. Preferably, the second weft may consist mainly of a textured bulky yarn and/or a yarn made of mainly composite staple fibers having a potential crimping property. It is also practical to use such a yarn as the yarn utilized as the warp, wherein the crimps of the component filaments are substantially eliminated. It is necessary to use a multifilament yarn wherein the thickness of each component individual filament is in a range between 1.0 d and 8.0 d. This is because, if the thickness of individual filaments is less than 1.0 d, the resulting fabric becomes poor in bulkiness or puffiness, and if the thickness is more than 8.0 d, the fabric becomes stiff and has a harsh and hard feel and a harsh feel on the back side surface of the fabric. In experimental tests conducted by the inventors, it was found that the thickness of individual filament contained in the second weft is preferably in a range between 1.5 d and 4.0 d.

The textured bulky yarns employable for the fabric of the present invention as a second weft may be selected from the various well-known textured yarns such as false-twisted yarns, edge crimped yarns and the like. A draw-false-twisted yarn from a pre-oriented yarn may also be employed with an economical advantage.

As the second weft, a crimped yarn or a yarn having crimping capacity utilizing such conjugate fiber as a side-by-side type or eccentric sheath-core type may be employed. However, since the yarn made of such a conjugate fiber may not produce sufficient bulkiness, it is preferable to select the component polymers or spinning conditions for its preparation or the conditions for generating crimps so as to obtain a bulkiness as high as possible. As mentioned above, a spun yarn may be utilized for the second weft, however, the use of the multifilament yarn as the second weft is more preferable in comparison with the above-mentioned spun yarn.

The merits attained by the utilization of a bulky yarn as the second weft are as follows.

(a) A voluminous and puffy feeling fabric can be obtained.

(b) A specific feel can be obtained by the use, in combination, of a first weft comprising extra fine fibers constituting the raised fibers and a second weft and a warp which mainly act as the yarns constituting the base fabric.

(c) It is possible to alleviate the contraction of the fabric in the direction of wefts which may occur at the time of the raising operation.

(d) A uniform balance between the warp and the weft can be obtained by weaving the combined weave fabric in spite of utilizing the first weft consisting mainly of the extra fine fibers, because, even though the above-mentioned first weft lacks the pertinent resiliency, the above-mentioned second weft has sufficient resiliency to cover the weak property of the first weft.

(e) Creasing is unlikely.

(f) An excellent permanent pleating quality can be attained.

(g) In the case where a bulky yarn is employed as the weft, it is possible to attain dimensional stability and a constant feel in the fabric, and to control the density and smoothness of the raised fibers only through the use of a pin or clip stenter of ordinary type; while it is very difficult to obtain such quality, because of the difficulty in controlling the longitudinal contraction, in the case where a bulky yarn is employed as the warp.

The respective yarns used as the warp, the first weft and the second weft, are preferably woven into a weft backed weave so that the first weft mainly appears on the face surface of the woven fabric, while the second weft mainly appears on the back surface of the fabric. Preferably, the face surface mainly containing the first weft has a weave from 4-harness satin (for example, turkish weave or broken twill) to 8-harness satin. Thus, each thread of the first weft floats over the adjoining 3 to 7 threads of the warp. Preferably, the number of the first weft floats is 3 or 4.

Figure 2:
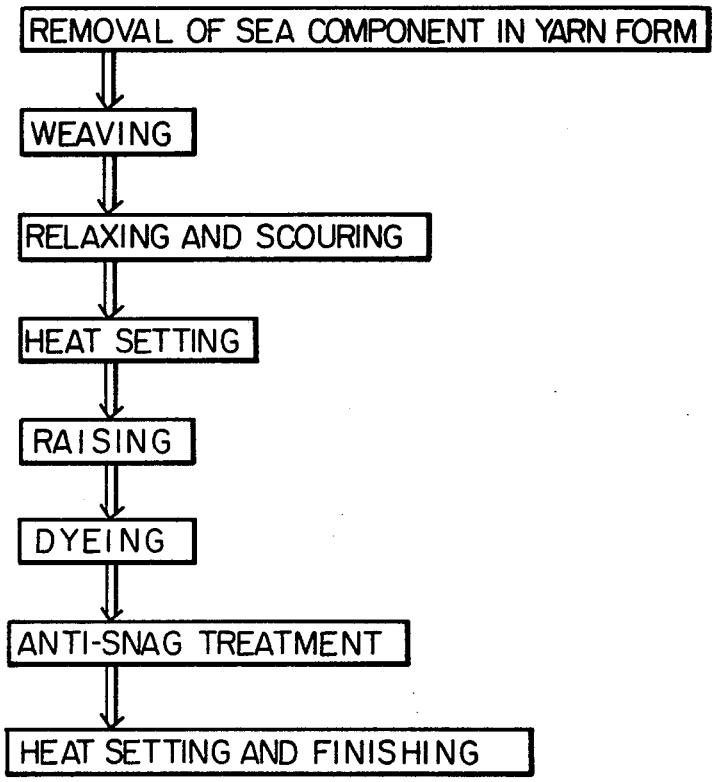
Figure 3:
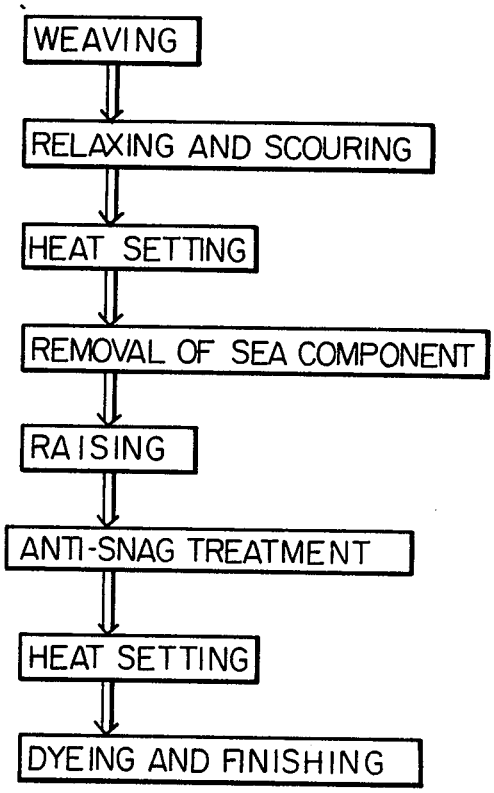
Figure 4:
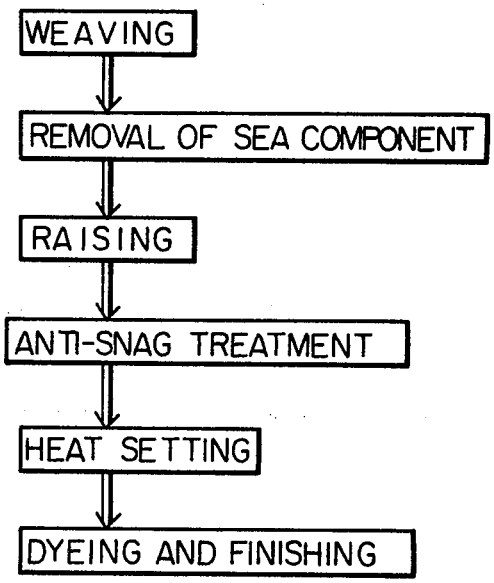
Figure 5:
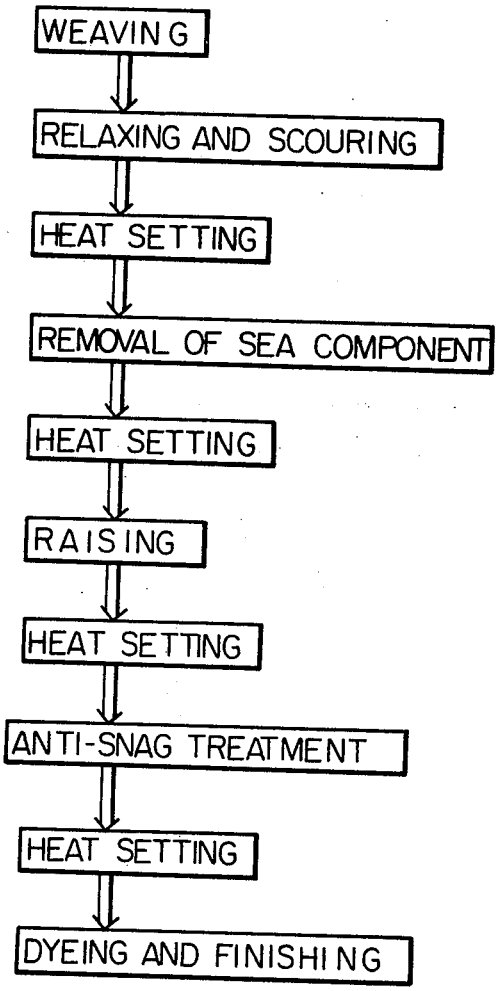
Figure 6:
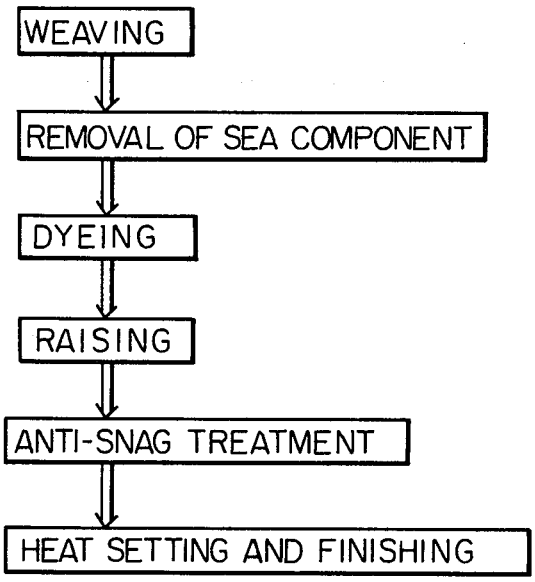

Next, the method for manufacturing the above-mentioned suede-like fabric is explained in detail with reference to the flow charts shown in FIGS. 1, 2, 3, 4, 5 and 6, respectively.

In the practice of the process of the invention, various combinations of the steps may be employed. The woven fabric having such a combination weave is subjected to heat treatment before or after the raising operation. The heat treatment includes at least one of the bulking up and heat setting treatments. With respect to polyester fibers, the heat setting operation may preferably be carried out at a temperature between 140° C and 230° C, while the bulking up operation may be carried out by immersing the fabric in boiling water.

The woven fabric is, in addition, subjected to raising. The raising includes wire card clothing raising, teasel raising, emerizing, brushing and the like. Of these, the card clothing raising is particularly preferred.

The fabric may be treated with a finishing agent such as an anti-pilling agent, for example, an emulsion or solution of a polyurethane resin, or a snagging, resin finishing, anti-fraying or anti-slippage agent. These finishing agents may be applied in an appropriate amount and by a convenient method, as required to the desired quality.

If desired, the fabric may be subjected to further finishing treatments such as dyeing, shearing, brushing, anti-static finishing, finishing oiling, flame-retarding finishing, polishing, water-repelling finishing, soil-releasing finishing, sliming finishing and the like. The feel of the fabric may preferably changed by heat pressing or ironing.

Dyeing may be carried out before or after the raising operation. It is possible to dye the fabric so that the extra fine fibers have a depth of color different from or the same as that of the other fibers of ordinary thickness. However, it is preferable, in general, that both the extra fine fibers and the other fibers be dyed in the same depth of color. This can be done by the proper selection of the dyeing conditions.

The raised fibers can be bent in any desirable direction. It is preferable that the raised fibers be violently raked with the liquid during dyeing. This is because the raised fibers then become likely to be seen as being very dense. It is also preferable that the raised fibers be combed or brushed after dyeing but before drying. The raised fibers may be intentionally disordered so as to obtain a fabric having a fancy appearance.

Because of the aforementioned desirable features of the raised woven fabric of the invention, the fabric has many uses, such as for high class wearing apparel, such as, coats, dresses, shirts and trousers, and; in addition, for bags, shoes, carpets, filters, swaddling cloths, menstruation articles, cushions, substitutes for felt and leather, sporting articles, furniture covers, medical supplies, blankets, wiping cloths, fishery articles and agriculture and forestry articles.

The invention will now be further illustrated by the following examples, but many modification thereof can be employed. The procedures of Examples 1, 2, 3, 4, 5 and 9, Example 6, Examples 7 and 8, Example 10, Example 12 and Example 11 were carried out according to the processes as shown in FIGS. 1, 2, 3, 4, 5 and 6, respectively.

EXAMPLE 1

A 5-harness satin weft backed weave was made so that the woven density became 134 warp/in, 82 first wefts/in and 82 second wefts/in. As the warp, a 50 denier/24 multifilament yarn of polyethylene terephthalate (Trade Mark "Tetoron", by Toray Industries Inc.) was used; as the first weft, a $30^2/2$ (cotton yarn count system) spun yarn consisting of 3 denier islands-in-sea type composite filament staples of 51 mm length, wherein the island component consisted mainly of polyethylene terephthalate, the sea component consisted mainly of polystyrene, the percentage of the island component was 60%, the percentage of the sea component was 40% and the number of islands was 16, was used, and; as the second weft, a 50 denier/24 filaments false-twisted polyethylene terephthalate multifilament yarn (Trade Mark "Woolie Tetoron", by Toray Industries Inc.) was used.

This woven fabric was immersed in boiling water, desized, relaxed and scoured, whereby the fabric contracted by 8.5% in the warp direction and by 13.7% in the weft direction. Then, the fabric was heat set and dried at 180° C. The set and dried fabric contracted by 2.5% in the warp direction and by 6.1% in the weft direction, respectively, and became hard like cardboard.

The fabric was throughly washed three times with trichloroethylene to remove the sea component of the first weft and then dried. Then, after applying a raising oil agent, the fabric was passed through a raising machine provided with card clothing 10 times. Thus, a raised fabric was obtained, the surface of which was covered by raised fibers consisting of extra fine fibers of the first weft.

The fabric was then dyed a light brown shade with a disperse dye in a pressure dyeing machine, treating with a finishing oiling agent and dried. The obtained fabric was a suede-like weft backed raised woven fabric having a balanced arrangement of warp and weft, and dense fibers raised from the base construction of the fabric. This suede-like fabric was excellent in draping quality and in permanent pleating quality. The surface of the fabric had a soft feel and lustrous appearance, and it was possible to create so-called finger marks on the surface of the fabric as on a genuine suede leather.

In order to give pilling resistance and snag resistance to this fabric, the fabric was impregnated with an aqueous liquor containing 2% by weight of an anionic bisulfite adduct of polyisocyanate polyurethane, expressed, dried at 150° C and then brushed. The obtained weft backed raised woven fabric was excellent in pilling resistance and in snag resistance, and had well balanced warp and weft arrangement, and surface naps like those of a genuine suede leather.

EXAMPLE 2

Using a 150 denier/48 filament yarn of polyethylene terephthalate (Trade Mark "Tetoron") as the warp and as the second weft, and a $20^2/2$ (cotton yarn count system) spun yarn consisting of 3 denier islands-in-sea type composite filament staples of 51 mm length, wherein the island component consisted mainly of polyethylene terephthalate, the sea component consisted mainly of polystyrene, the percentage of the island component was 50%, the percentage of the sea component was 50%, the number of islands was 16 and the number of crimps was 12/in, as first weft, a 5-harness satin weft backed weave was made. The woven density was 99 warps/in, 50 first weft/in and 50 second weft/in. The weave construction of the selvage of this fabric was a 2/1 twill.

This woven fabric was processed as described in Example 1 and a high class suede-like weft backed raised woven fabric was produced. The fabric was voluminous and excellent in permanent pleating quality, and in pilling resistance, and had dense raised fibers and a soft feeling surface whereon so-called finger marks could be easily created.

EXAMPLE 3

A weft backed weave was made so that the face weave had an 8-harness satin weave and the back weave a regular plain weave. Used as the warp was a 50 denier/18 filament false-twisted multifilament yarn of polyethylene terephthalate (Trade Mark "Tetoron"), the crimps of which had been eliminated by heat setting under tension; used as first weft was a $40^s/2$ spun yarn (cotton yarn count system) consisting of islands-in-sea type composite filament staples, wherein the island component consisted mainly of polyethylene terephthalate, the sea component consisted mainly of polystyrene, the percentage of the island component was 75%, the percentage of the sea component was 25%, the number of the islands was 36, the thickness thereof was 2.0 denier, the length was 51 mm and the number of crimps 11/in, and; used as second weft was a 50 denier/18 filament false-twisted polyethylene terephthalate multifilament yarn (Trade Mark "Woolli Tetoron"). The woven density was 137 warps/in, 78 first wefts/in and 78 second wefts/in.

This woven fabric was immersed in boiling water, desized, relaxed and scoured, and then, heat-set and dried at 180° C. The contraction of the treated fabric was 13.2% in the warp direction and 19.3% in the weft direction. The treated fabric became very hard like cardboard.

The fabric was thoroughly washed 5 times with trichloroethylene, to remove the sea component of the islands-in-sea type composite fibers of the first weft, and then, dried. Then, after applying a raising oil agent and drying on a cylinder dryer, the fabric was subjected to raising by passing it through a conventional French type raising machine provided with card clothing thirteen times. Thus, a raised fabric was obtained, the surface of which was covered by raised fibers consisting of extra fine fibers of the first weft.

The fabric was then dyed a deep brown shade with a disperse dye in a circular pressing dyeing machine, treated with a finishing oiling agent, heat-set and dried. The obtained fabric was a suede-like weft backed raised woven fabric having dense raised fibers and a balanced warp and weft arrangement, and having an excellent draping quality and permanent pleating quality. The fabric had a lustrous appearance and soft feeling surface whereon so-called finger marks could be easily produced.

This fabric was then impregnated with an aqueous emulsion containing 1.5% by weight of polyurethane, expressed between nip rollers, heat-set and dried at 160° C, and brushed. The obtained weft backed raised woven fabric was excellent in pilling resistance and in snag resistance, and had a soft feeling surface whereon so-called finger marks as on a genuine leather could be easily produced.

EXAMPLE 4

A weft backed weave was made in such conditions that the face weave construction was a 5-harness satin weave while the back weave construction was 2/3 twill. A $60^s/2$ (cotton yarn count system) spun yarn consisting of polyethylene terephthalate staples, wherein the thickness of individual fiber was 1.5 denier, the length thereof was 38 mm and the number of crimps was 11/in, was used as the warp and as the second weft, and; a $30^s/3$ spun yarn consisting of islands-in-sea type composite filament staples, wherein the island component consisted mainly of polyethylene terephthalate, the sea component consisted mainly of polystyrene, the percentage of the island component was 65%, the percentage of the sea component was 35%, the number of islands was 16, the thickness of individual fiber was 2.5 denier, the length thereof was 51 mm and the number of crimps of each fiber was 11/in, was used as the first weft. The woven density was 100 warps/in, 52 first wefts/in and 52 second wefts/in.

This woven fabric was processed as described in Example 3 and a high class suede-like weft backed raised woven fabric was obtained. The fabric was excellent in pilling resistance and in snag resistance, and had balanced warp and weft arrangement, and a soft feeling surface whereon finger marks could be easily produced.

EXAMPLE 5

A 5-harness satin weft backed weave having a woven density of 107 warps/in, 51 first wefts/in and 51 second wefts/in was made. As the warp a 110 denier/24 filament yarn of nylon 6 was used; as the first weft a $30^s/3$ (cotton yarn count system) spun yarn consisting of islands-in-sea type composite filament staples, wherein the island component consisted of nylon 6, the sea component consisted of a copolymer of 24% by weight of acrylonitrile and 76% by weight of styrene, the percentage of the island component was 55%, the percentage of the sea component was 45%, the number of islands was 36, the fineness of individual fiber was 2.5 denier, the length thereof was 51 mm and the number of crimps in each fiber was 11/in, was used, and; as the second weft a 110 denier/24 filament wooly false-twisted multifilament yarn of nylon 6 was used.

This woven fabric was processed as described in Example 1, except that it was dyed a beige shade with an acid dye in a winch beck under atmospheric pressure. The thus produced fabric was a suede-like raised woven fabric having a brilliant shade and balanced warp and weft, and being excellent in pilling resistance and in snag resistance. The fabric had surface naps like those of a genuine suede leather.

EXAMPLE 6

A fabric of the 5-harness satin weft back weave was made by utilizing the following warp, and first and second weft. That is, as the first weft, a $30^s/2$ (cotton yarn count system) spun yarn consisting of islands-in-sea type composite filament staples was used as a material. In each individual fiber, the island component consisted mainly of polyethylene terephthalate, the sea component consisted mainly of polystyrene, the percentage of the island component was 70%, the percentage of the sea component was 30%, the number of islands was 16, the thickness of individual fiber was 2.8 denier, the length thereof was 51 mm and the number of crimps in each fiber was 12/in. This yarn was thoroughly washed with trichloroethylene to remove the sea component so as to produce a spun yarn of $43^s/2$. As the second weft, a false-twisted multifilament polyethylene terephthalate yarn of 75 d/36 filaments (Trade Mark "Woollie Tetron") was utilized, while as the warp, a multifilament polyethylene terephthalate yarn of 75 d/36 filament (Trade Mark "Tetron") was utilized. The yarn density of the fabric was 119 warps/in, 80 first weft/in and 80 second weft/in.

This woven fabric was immersed in boiling water, desized, relaxed and scoured, and then, heat-set and dried at 180° C. During this treatment, the fabric contracted by 3% in the warp direction and 12.3% in the weft direction.

Then, after applying a raising oil agent, the fabric was passed through a French type raising machine provided with card clothing 16 times and a raised fabric, the surface of which was covered by raised fibers consisting of extra fine fibers of the first weft, was obtained.

The fabric was then dyed a light brown shade with a disperse dye in a circular pressing dyeing machine, treated with a finishing oiling agent, heat-set and dried. The obtained fabric was a suede-like weft backed raised woven fabric having dense surface naps and having an excellent draping quality and permanent pleating quality. The fabric had a soft feeling surface whereon finger marks as on a genuine leather could be easily produced.

The fabric was further treated as described in Example 3 to give it snag resistance. The treated fabric was excellent in pilling resistance and in snag resistance.

EXAMPLE 7

A weft backed weave consisting of a face weave construction of a 4-harness satin weave and a back weave of a basket weave construction was made. Used as the warp was a 100 denier/48 filament polyethylene terephthalate multifilament yarn (Trade Mark "Tetoron"); used as the first weft was a $20^s/2$ spun yarn consisting of islands-in-sea type composite filament staples, wherein the island component consisted mainly of polyethylene terephthalate, the sea component consisted mainly of polystyrene, the percentage of the island component was 80%, the percentage of the sea component was 20%, the number of islands was 36, the thickness of individual fiber was 3.0 denier, the length thereof was 51 mm and the number of crimps in each fiber was 12/in, and; used as the second weft was a 100 denier/48 filament false-twisted polyethylene terephthalate multifilament yarn (Trade Mark "Woollie Tetoron"). The woven density of the fabric was 114 warps/in, 52 first wefts/in and 52 second wefts/in.

This woven fabric was immersed in boiling water, desized, relaxed and scoured, and then, heat-set and dried at a temperature of 160° to 180° C. The contraction of the treated fabric was 10.3% in the warp direction and 18.6% in the weft direction.

The obtained cardboard-like hard fabric was thoroughly washed five times with trichloroethylene to remove the sea component of the first weft. Then, after applying a raising oil agent, the fabric was passed through a hydraulic raising machine provided with card clothing 18 times. A raised fabric was obtained, the surface of which was covered by raised fibers consisting of extra fine fibers of the first weft.

This fabric was then impregnated with an aqueous emulsion containing 10% by weight of polyurethane, expressed between nip rollers and dried at a temperatue of 100° to 120° C. Then, the face side surface was treated on a brush-roll or sand-roll to scrape off the successive polyurethane on the surface. The fabric was then heat-set and dried at a temperature of 160° to 180° C, and the polyurethane was cured. The fabric was dyed a beige shade with a disperse dye in a circular pressing dyeing machine, treated with a finishing oiling agent, roughly brushed and dried.

The fabric thus obtained was a suede-like raised woven fabric having dense raised fibers, and balanced warp and weft, and was excellent in draping quality, permanent pleating quality and pilling resistance. The fabric had surface naps like those of a genuine suede leather.

EXAMPLE 8

The procedure as described in Example 7 was repeated. However, in this example, the fabric was dyed in tubular forms of two types. One was in a tubular form such that one selvage was piled up on the other selvage and they were sewn together so as to set the raised side of the fabric outside, and; the other was in a tubular form such that the respective pairs of the piled up selvages of two pieces of the fabric were sewn so as to set the raised sides of the two pieces of the fabric outside.

Each of the bags was dyed at 125° C for 45 minutes, using a disperse dye in a circular pressure dyeing machine, and then, the bath was slowly cooled to 80° C. Then, the fabric was washed with hot water, subjected to reduction washing and rinsed. The thread was removed from the sewn selvages and the raised side of the fabric was subjected to wet combing by brushing said side in a prescribed direction. Then, the fabric was treated with a finishing oiling agent and dried at 130° C.

Each fabric obtained had a lustrous surface having longer raised fibers, as compared with the fabric obtained in Example 7. The back side of the fabric had very little fuzz in pill form.

EXAMPLE 9

The procedure as described in Example 1 was repeated, except that the warp, first weft and second weft were, respectively, different. That is, instead of utilizing the polyethylene terephthalate used in Example 1 to produce the warp and the first and second wefts, polyethylene terephthalate containing 8.5 mole% of copolymerized sodiumsulfoisophthalic acid was employed. Further, in this example, the raised fabric was dyed by using a basic dye instead of the disperse dye. A suede-like woven fabric of a brilliant shade was obtained.

EXAMPLE 10

A five-harness satin weft backed weave as described in Example 1 was firstly washed with trichloroethylene five times, to remove the sea component from the islands-in-sea type composite fibers of the first weft, and then dried. After applying a raising oil agent, the fabric was passed through a raising machine provided with card clothing seventeen times and a raised fabric having raised fibers consisting of extra fine fibers of the first weft covering its surface was obtained.

The fabric was then impregnated with an aqueous liquid containing 8% by weight of an anionic bisulfite adduct of polyisocyanate polyurethane, expressed and dried at a temperature of 110° to 120° C. The front side surface was then napped with sandpaper and the fabric was heat-set at a temperature of 160° to 180° C.

Then, the fabric was dyed a light brown shade with a disperse dye in a circular pressure dyeing machine, treated with a finishing oiling-agent, wet brushed to dress the surface naps in a prescribed direction and, then, dried.

A suede-like weft backed raised woven fabric was obtained, which had excellent pilling resistance and snag resistance, a balanced warp and weft arrangement, soft surface naps and a lustrous surface whereon finger marks as on a genuine leather could be easily produced.

EXAMPLE 11

A five-harness satin weft backed weave as described in Example 1 was firstly washed with trichloroethylene five times, to remove the sea component from the islands-in-sea type composite fibers of the first weft, and then dried. The fabric was then dyed a brown shade with a disperse dye in a circular pressure dyeing machine. After applying a raising oil agent, the fabric was dried on a cylinder dryer and passed through a hydraulic raising machine provided with card clothing ninteen times. A raised woven fabric having raised fibers consisting of extra fine fibers of the first weft covering its surface was obtained.

This fabric was then impregnated with an aqueous emulsion containing 12% by weight of polyurethane, expressed between nip rollers and dried at a temperature of 110° to 120° C. Then, the face side surface was treated on a brush-roll or sand-roll and the fabric was heat-set at a temperature of 160° to 180° C.

The obtained weft backed raised woven fabric had a balanced warp and weft arrangement, excellent pilling resistance and snag resistance, soft surface naps and a suede-like surface whereon finger marks could be easily produced.

EXAMPLE 12

A five-harness satin weft backed weave as described in Example 1 was immersed in boiling water, desized, relaxed and scoured, and heat-set at a temperature of 160° to 180° C. The treated fabric was contracted by 11.0% in the warp direction and by 19.8% in the weft direction and became very hard like cardboard.

The fabric was thoroughly washed with trichloroethylene five times, to remove the sea component of the first weft islands-in-sea type composite fibers, and then, heat-set and dried at a temperature of 160° to 180° C. This resulted in the fabric having the feel of a normal woven fabric.

After applying a raising oil agent, the fabric was dried on a cylinder dryer at a temperature of 115° to 120° C and, then, subjected to raising by passing it through a raising machine provided with a conventional card clothing fifteen times to obtain a raised fabric having raised extra fine fibers covering its surface. After heat setting at a temperature of 160° to 180° C, the fabric was impregnated with an aqueous emulsion containing 10% by weight of polyurethane, expressed between nip rollers and dried at a temperature of 110° to 120° C. Then, the front side surface was subjected to scraping on a brush-roll or sand-roll and heat-set at a temperature of 160° to 180° C.

The fabric was then dyed a brown shade with a disperse dye in a circular pressing dyeing machine, treated with a finishing oiling agent, wet brushed to dress the surface naps in a prescribed direction and, then, dried at 120° C. A suede-like weft backed raised woven fabric was obtained, which had lustrous surface naps, a balanced warp and weft arrangement, and excellent pilling resistance and snag resistance.

What is claimed is:

1. A suede-like raised woven fabric of combination weave construction having raised fibers covering the surface thereof, comprising a warp yarn of 30 to 300 denier consisting mainly of fibers each having a thickness of 1.0 to 8.0 denier; a first weft spun yarn of 50 to 1,000 denier consisting of plural staple fibers, each staple consisting of a bundle of extra fine component fibers of 0.0001 to 0.4 denier; a second weft yarn of 30 to 300 denier consisting mainly of fibers having a thickness in a range between 1.0 and 8.0 denier, at least one of said warp and said second weft being substantially free from crimps, each thread of said first weft floating over the adjoining three to seven threads of said warp, said raised fiber consisting of said extra fine component fibers of said first weft.

2. A suede-like raised woven fabric according to claim 1, wherein said first weft is provided with such a configuration that plural staple fibers are gathered in each section of said yarn and each staple fiber is a bundle of plural extra fine component fibers.

3. A suede-like raised woven fabric according to claim 1, wherein said fibers forming either one of said warp and second weft are monofilaments.

4. A suede-like raised woven fabric according to claim 1, wherein said fibers forming either one of said warp and said second weft are staple fibers.

5. A suede-like raised woven fabric according to claim 1, wherein the number of the second weft floats is less than the number of the first weft floats.

6. A suede-like raised woven fabric according to claim 1, wherein said second weft yarn has crimps.

7. A suede-like raised woven fabric according to claim 1, wherein said warp yarn has substantially no crimps.

8. A suede-like raised woven fabric according to claim 1, wherein said warp yarn is a yarn of continuous multifilaments, the total denier of which is in a range between 40 d and 100 d, and the monofilament denier of which is in a range between 1.2 d and 4.5 d.

9. A suede-like raised woven fabric according to claim 1, wherein the total denier of said first weft yarn is in a range between 70 d and 450 d.

10. A suede-like raised woven fabric according to claim 1, wherein said second weft yarn is a yarn of continuous multifilaments, the monofilament denier of which is in a range between 1.5 d and 4.0 d.

11. A suede-like raised woven fabric according to claim 1, wherein said second weft yarn consists of conjugated filaments.

12. A suede-like raised woven fabric according to claim 1, wherein each thread of said first weft floats toward the adjoining three or four threads of said warp.

13. A suede-like raised woven fabric according to claim 1, wherein said fabric is resin finished.

14. A suede-like raised woven fabric according to claim 1, wherein said fabric has a weft backed weave.

15. A process for the preparation of a suede-like raised woven fabric, which comprises the steps of:

(a) weaving a fabric of a combination weave, wherein at least one of the warp and a second weft is substantially free from crimps and each thread of a first weft floats over the adjoining three to seven threads of the warp, using as the warp a yarn of 30 to 300 denier consisting mainly of fibers each having a thickness of 1.0 to 8.0 denier using as the first weft, a spun yarn of 50 to 1,000 denier of multi-core composite staple fibers, each staple fiber consisting of a bundle of extra fine fiber components each having a fineness of 0.0001 to 0.4 denier, and using as the second weft, a yarn of 30 to 300 denier consisting mainly of fibers each having a thickness of 1.0 to 8.0 denier;

(b) removing a component surrounding the cores of said multi-core composite fibers of the yarn constituting said first weft of the woven fabric;

(c) subjecting the woven fabric to heat treatment, and;

(d) subjecting the woven fabric to raising.

16. A process according to claim 15, wherein the woven fabric is firstly subjected to heat treatment, then, treated to remove the core-surrounding component and, thereafter, subjected to raising.

17. A process according to claim 15, wherein the woven fabric is firstly treated to remove the core-surrounding component, then subjected to raising and, thereafter, subjected to heat treatment.

18. A process according to claim 15, wherein the woven fabric is firstly treated to remove the core-surrounding component, then subjected to heat treatment and, thereafter, subjected to raising.

19. A process according to claim 15, wherein the woven fabric is firstly subjected to raising, then treated to remove the core-surrounding component and, thereafter, subjected to heat treatment.

20. A process according to claim 15, wherein the heat treatment is carried out at a temperature between 140° C and 230° C.

21. A process according to claim 15, wherein the fabric is further subjected to resin finishing.

22. A process according to claim 15, wherein the fabric is further treated with a sizing agent, then subjected to resin finishing and, thereafter, treated to remove the sizing agent.

23. A process according to claim 15, wherein the fabric is further subjected to dyeing or hot water treatment in a tubular form such that the fabric is sewn up so as to set the raised side thereof outside.

24. A process for the preparation of a suede-like raised woven fabric, wherein comprises the steps of:

(a) weaving a fabric of a combination weave, wherein at least one of the warp and a second weft is substantially free from crimps and each thread of a first weft floats over the adjoining three to seven threads of the warp, using as the warp a yarn of 30 to 300 denier, consisting mainly of fibers each having a thickness of 1.0 to 8.0 denier, using as the first weft, a spun yarn of 50 to 1,000 denier of a plurality of staple fibers, each staple fiber consisting of a bundle of extra fine fiber components each having a fineness of 0.0001 to 0.4 denier, and using as the second weft a yarn of 30 to 300 denier, consisting mainly of fibers each having a thickness of 1.0 to 8.0 denier;

(b) subjecting the woven fabric to heat treatment, and;

(c) subjecting the woven fabric to raising.

25. A process according to claim 24, wherein the woven fabric is firstly subjected to heat treatment and then subjected to raising.

26. A process according to claim 24, wherein the woven fabric is firstly subjected to raising and then subjected to heat treatment.

27. A process according to claim 24, wherein the heat treatment is carried out at a temperature between 140° C and 230° C.

28. A process according to claim 24, wherein the fabric is further subjected to resin finishing.

29. A process according to claim 24, wherein the fabric is further treated with a sizing agent, then subjected to resin finishing and, thereafter, treated to remove the sizing agent.

30. A process according to claim 24, wherein the fabric is further subjected to dyeing or hot water treatment in a tubular form such that the fabric is sewn up so as to set the raised side thereof outside.

* * * * *